US008085961B2

(12) United States Patent
Aschoff et al.

(10) Patent No.: US 8,085,961 B2
(45) Date of Patent: Dec. 27, 2011

(54) HEARING DEVICE AND METHOD FOR MONITORING THE HEARING ABILITY OF A PERSON WITH IMPAIRED HEARING

(75) Inventors: Stefan Aschoff, Bubenreuth (DE); Matthias Fröhlich, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1368 days.

(21) Appl. No.: 11/361,289

(22) Filed: Feb. 23, 2006

(65) Prior Publication Data

US 2007/0269067 A1 Nov. 22, 2007

(30) Foreign Application Priority Data

Feb. 23, 2005 (DE) ..... 10 2005 008 316

(51) Int. Cl.
*H04R 25/00* (2006.01)

(52) U.S. Cl. ..... 381/321; 381/317; 381/318; 381/60

(58) Field of Classification Search ..... 381/321, 381/316–318, 60
See application file for complete search history.

(56) References Cited

U.S. PATENT DOCUMENTS

| | | | | |
|---|---|---|---|---|
| 4,947,432 | A | 8/1990 | Topholm | |
| 5,604,812 | A * | 2/1997 | Meyer | 381/314 |
| 6,751,325 | B1 * | 6/2004 | Fischer | 381/313 |

FOREIGN PATENT DOCUMENTS

| | | |
|---|---|---|
| DE | 40 20 154 A1 | 1/1992 |
| EP | 0 335 542 | 3/1989 |
| EP | 1 351 552 A2 | 3/2003 |
| EP | 1 367 857 A1 | 5/2003 |
| EP | 1 467 595 | 4/2004 |
| WO | WO 03/098970 | 11/2003 |

* cited by examiner

*Primary Examiner* — Davetta W Goins
*Assistant Examiner* — Jasmine Pritchard
(74) *Attorney, Agent, or Firm* — Schiff Hardin LLP

(57) ABSTRACT

A hearing device and method for monitoring the hearing ability of a person with impaired hearing allow changes of the hearing ability specifically of a person wearing a hearing aid are to be better able to be registered and taken into account. For this purpose, the setting of an operating element, this serves for setting an output sound level of a hearing device. Furthermore, the ambient sound level in the vicinity of the hearing device is measured. After that, the current setting is compared with the current, measured ambient sound level and a corresponding control signal is output dependent on the result of the comparison. This control signal serves, for example, for signaling to the wearer of a hearing aid the loss of hearing or the automatic adjustment of the hearing aid.

13 Claims, 2 Drawing Sheets

HEARING DEVICE AND METHOD FOR MONITORING THE HEARING ABILITY OF A PERSON WITH IMPAIRED HEARING

BACKGROUND OF THE INVENTION

1. Field of the Invention

The present invention relates to a hearing device, in particular a hearing aid, of the type having at least one operating element for setting an output sound level of the hearing device, the operating element being adjustable to a number of settings. In addition, the present invention relates to a method for monitoring the hearing ability of a person with impaired hearing.

2. Description of the Prior Art

The hearing ability of a person with impaired hearing is not constant, but a variable that changes as a result of learning, aging and other processes. If a person with impaired hearing is already fitted with a hearing system, such a change should lead to readjustment of the hearing system.

Two typical situations can be mentioned in particular in this respect:

a) a hearing ability that has changed over the course of weeks or months, which occurs as a result of a learning effect as the user becomes accustomed to the hearing system (so-called acclimatization).

b) a deterioration in the hearing ability occurring over the course of months or years.

A "hearing system" refers here to one or two hearing aids, which may optionally also be equipped with a remote control. In this case, the remote control may also have functions that assist the signal processing of the hearing aid/hearing aids.

According to the current state of the art, the person with impaired hearing must take responsibility for responding to the aforementioned situations a) and b) as follows:

With a): In the case of acclimatization, the person with impaired hearing goes at regular intervals of weeks or months to the acoustician, who, on the basis of an examination or questioning of his patient, possibly changes the set of parameters of the hearing system. The software used for this has usually been prepared already to the extent that the acoustician activates the next of a small number of setting stages (so-called "acclimatization stages").

With b): In the case of a deteriorating hearing ability, usually taking place slowly, the person with impaired hearing has the responsibility for reducing the setting possibilities available to him on the device. Here it is possible that the person with impaired hearing is not aware of the deterioration in his hearing ability, therefore also does not take the opportunity of newly optimizing his hearing aid setting and gradually arrives ultimately at a point where he is not getting the most from his hearing aid.

In this connection, it is known from the document EP 1 351 552 A2 to classify the acoustic input signal and use the result as an input criterion for the determination of a set of hearing aid parameters. For this purpose, the classification result is fed to a complex application logic.

Furthermore, there are numerous proposals for storing data in a hearing aid. This may be data transferred to the hearing aid from the outside (for example DE 40 20 154 A: storage of device- and customer-specific data). Similarly, it may be data representing the adjusting position of an operating element of the hearing aid and data taken from the set of parameters controlling the signal processing. In addition, EP 1 367 857 A1 proposes storing the input signal for further evaluation.

Swiss Application CH 672 215 A5 discloses a programmable hearing aid which has an amplifier and transmission section that can be controlled in its transmission characteristics. A detector-amplifier connected downstream of the microphone determines an ambient or background noise, compares it with stored noise level patterns and, by means of a control circuit, brings about an automatic selection of one of the stored groups of parameters that come closest to the determined noise level pattern. The detector-amplifier thereby controls the emission of the signals corresponding to the parameters to the actual hearing aid.

SUMMARY OF THE INVENTION

An object of the present invention is to provide a hearing device with which the current hearing ability of the user is automatically taken into account in the signal processing.

This object is achieved according to the invention by a hearing device, in particular a hearing aid, with at least one operating element for setting an output sound level of the hearing device, by the operating element being adjustable to a number of settings, a level measuring unit for measuring an ambient sound level in the vicinity of the hearing device and an evaluation unit for comparing a current setting position with a current, measured ambient sound level and for outputting a control signal in dependence on the result of the comparison.

In addition, a method for monitoring the hearing ability of a person with impaired hearing according to the invention includes the steps of sensing a setting of an operating element which serves for setting an output sound level of a hearing device, measuring an ambient sound level in the vicinity of the hearing device, comparing a current setting with a current, measured ambient sound level and outputting a control signal dependent on the result of the comparison.

The hearing system or the hearing device consequently automatically detects on the basis of the settings chosen by the wearer a change of the hearing ability and can either automatically perform corrections or indicate this situation to the person with impaired hearing. Consequently, a change of the hearing ability of the person with impaired hearing, and with it less than optimum use by him of the aid, does not go unnoticed. It should also be considered as particularly advantageous that the number of visits to the acoustician is reduced.

The control signal which the evaluation unit of the hearing device according to the invention generates preferably is used for readjusting an amplification of the hearing device. This leaves the user with a setting range that is as wide as possible, without the user constantly having to operate his or her device at a limit of the settings.

In a preferred embodiment, the hearing device according to the invention has a signaling unit, in order to inform the user of the hearing device dependent on the control signal by means of an information signal. For this purpose, for example an acoustic or optical signal is emitted from a hearing aid.

In addition, the hearing device may have a signal transmission unit for transmitting the control signal or a corresponding signal to an external device. In an embodiment, the external device has a text output unit. In this way, a text message can reach the user via a remote control, a smart phone and the like.

In the hearing device according to the invention, a storage unit can be provided for recording a history of comparison results, the control signal being generated by the evaluation unit in dependence on the history. This also allows the time factor that characterizes the changing of the hearing ability to be taken into account in the information provided to the user or in the automatic readjustment.

It is favorable for one or more average values to be continuously determined by the level measuring means. In this way, better account can be taken of certain ambient situations.

When processing the setting of the operating element of the hearing device, it is favorable for each setting to be assigned a setting level by the evaluation unit and for this to be used to produce a difference between the setting level and the ambient sound level for further processing. It is then only necessary to store the difference to monitor the hearing ability.

DESCRIPTION OF THE PREFERRED EMBODIMENTS

Corresponding to the basic concept of the present invention, a hearing system is provided with the capability of measuring the ambient sound level and bringing this measured value into a relationship with preferred settings of operating elements, which regulate the output sound level of the hearing system. For this purpose, an evaluation unit analyzes a measured level value and a setting, stores a corresponding comparison value and activates a special function if the comparison value indicates a changed hearing ability. This allows the following response to the situations a) and b) presented above:

To a): When a user is becoming accustomed to a hearing system, the corresponding, preprogrammed acclimatization stage can be automatically activated as soon as the aforementioned evaluation unit initiates it. Alternatively, the corresponding hearing aid may also readjust the amplification of the hearing aid, so that the person with impaired hearing will always keep the volume adjuster in the same setting range.

To b): With hearing ability deteriorating in the long term, an acoustic detection signal is output, for example at the initiation of the evaluation unit, or a message is sent to an intelligent remote control, a smart phone or other system, which in response uses a text or other audio and/or visual feedback to draw the attention of the person with impaired hearing to his or her deteriorating hearing ability or recommend visiting a specialist.

Figure 1:
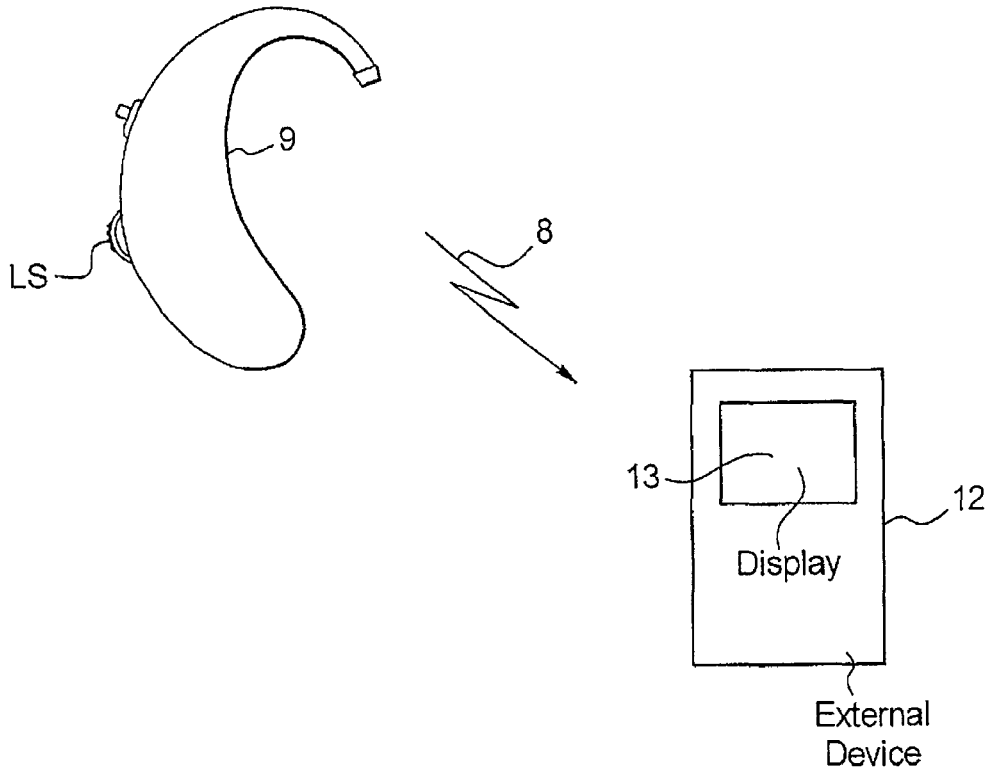
FIG. 1 shows the exterior of a hearing aid according to the invention, communicating with an external device.

As shown in FIG. 1, the hearing device has a housing 9 configured to be worn in the ear of the hearing-impaired person. The hearing aid housing 9 has an externally accessible, manually operable adjustment element LS, such as a speaker adjuster (amplification gain adjuster). A component within the hearing aid housing 9 (as explained below) emits a signal 8 that is received by an external device 12, having a display 13. The external device 12 can be the intelligent remote control or a smart phone or other system as noted above, and the aforementioned text or other visual feedback can be displayed at the display 13 thereof.

Figure 2:
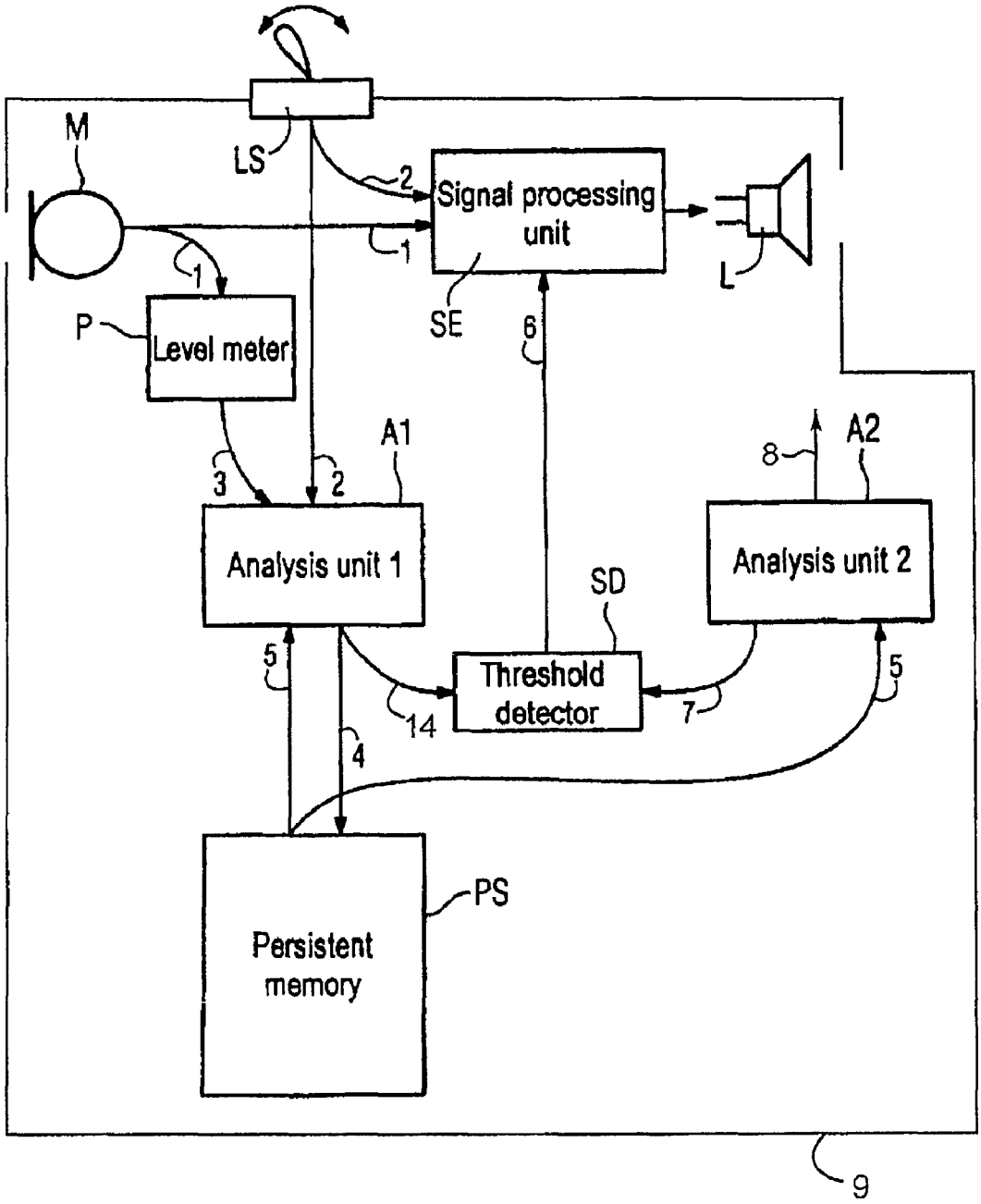
FIG. 2 is a block diagram of a hearing device according to the invention.

The actual configuration of the components within the hearing aid housing 9 according to the invention is schematically reproduced in FIG. 2. The hearing aid is provided with a microphone M and a level meter P connected to said microphone, the level meter P measuring the level of the input signal or microphone signal 1. As a result, the level of the ambient sound is registered. The microphone signal 1 is also fed in a customary way to a signal processing unit SE, which generates an output signal for a loudspeaker L.

The level meter P generates a level signal 3 of the output signal 1 and supplies it to an analysis unit A1. Furthermore, the analysis unit A1 also receives a position signal 2 of an operating element, here a speaker adjuster LS. The position signal 2 of the speaker adjuster LS is also used in an accustomed way in the signal processing unit SE.

The analysis unit A1 establishes a relationship between the position signal 2 of the loudspeaker adjuster LS and the level signal 3 of the level meter P and supplies a corresponding analysis value 4. This is fed to a threshold detector SD and a persistent memory PS. Optionally, one or more analysis values 5, which have previously been stored in the persistent memory PS, are provided by the non-volatile memory for the analysis unit A1, possibly including additional parameters. The output signal 4 of the analysis unit A1 is then correspondingly calculated, including these analysis values 5 and possibly other parameters.

The threshold detector SD receives for example a difference level, which the analysis unit A1 has determined from the ambient sound level 3 and an adjuster level assigned to the adjuster position 2. If the difference level exceeds a predetermined threshold value, the threshold detector SD triggers an activation signal 6 for a special function. In the present example, a change of the set of parameters of the signal processing unit SE is initiated by the activation signal 6.

Furthermore, the hearing aid according to the invention may have a second analysis unit A2, to which the data 5 of the memory PS are made available. The second analysis unit A2 analyzes these data on the basis of specific, predetermined criteria and performs one or more special functions, such as for example a warning function or self-adjustment. In the present example, an analysis value 7 is fed to the threshold detector SD for this purpose. The analysis unit A2 preferably serves the purpose of also analyzing the data stored in the persistent memory PS on a time basis and possibly making corresponding average values or other statistical data available.

In practice, the level meter P is preferably configured in such a way that it averages the ambient sound level over a predeterminable time interval and feeds the average value to the first analysis unit A1. In another embodiment, the level meter P is designed in such a way that it continuously carries out an averaging over a short time interval, for example 30 s, and over a long time interval, for example 5 min. In this case, for improved analysis two sliding values are available for the analysis unit A1 as a result.

An alternative embodiment is to use two level meters, upstream of which there is respectively a frequency filter, for example a high-pass filter and a low-pass filter. In this case as well, two values are fed to the first analysis unit A1.

The first analysis unit A1 preferably is designed to be activated in response to specific actuations of operating elements. After that, it stores the data described above, and possibly also a time and/or date stamp, in the nonvolatile or persistent memory PS. It is also possible to store there the number of the chosen hearing program and the current result of a classifier, which usually investigates the incoming signal in the signal processing path of the hearing aid and assigns it to one of a number of possible classes.

In addition, as already indicated, the analysis unit A1 may operate to form a difference value between the input signal level 3 and a setting level which has been assigned to the setting of the operating element. This difference value is then stored in the memory PS. If the difference value exceeds a predetermined threshold value, the amplification adjuster of the signal processing unit SE is adjusted.

In a simplified exemplary embodiment, the analysis unit A1 first calculates the difference between the input signal level 3 and the setting 2, then calculates from this difference value and a number of last-stored difference values a sliding average value and activates a special function only if the sliding average value exceeds a threshold value.

One particular benefit of the type of signal processing according to the invention is that, when handling the incoming audio signals and settings of operating elements, only the processing result is sent for storage. This reduces the volume of data to be stored, so that the hearing aid according to the invention can manage with a chip of a smaller area. Therefore, extensive data preprocessing is carried out before the data storage. In this preprocessing, an analysis and feature extraction is performed, so that the volume of data of the result values is significantly reduced in comparison with the original input signals.

Although modifications and changes may be suggested by those skilled in the art, it is the intention of the inventors to embody within the patent warranted hereon all changes and modifications as reasonably and properly come within the scope of their contribution to the art.

We claim as our invention:

1. A hearing device comprising:

a housing;

an audio input unit and an audio output unit contained in said housing, and a signal processor connected in said housing between said audio input unit and said audio output unit, said signal processor being configured to operate according to a plurality of processing parameters, each of said processing parameters having a setting within a setting range;

a manually-operable operating element mounted to and manually accessible from an exterior of said housing, said manually operable operating element, upon manual operation thereof, adjusting one of said parameters to a current setting, from among a plurality of settings in said setting range, to set a sound level at said audio output unit;

a level measuring unit connected in said housing to said audio input unit that measures an ambient sound level, detected by said audio input unit, in the vicinity of the housing;

an analysis unit in said housing that compares the current setting, manually made via the operating element, with a current, measured ambient sound level measured by said level measuring unit, to obtain a comparison result, and that generates a control signal, dependent on the comparison result, and supplies said control signal to said signal processor; and said signal processor being configured to automatically re-adjust the setting range of said one of said parameters when said comparison result indicates said current setting is at a boundary of said setting range.

2. The hearing device as claimed in claim 1 wherein said housing has a size and configuration allowing said housing to be worn at an ear of a hearing-impaired person.

3. The hearing device as claimed in claim 1 wherein said one of said parameters is amplification gain of said signal processing unit.

4. The hearing device as claimed in claim 1 wherein said housing has a size and configuration allowing said housing to be worn in an ear of a person having a hearing impairment, and wherein said analysis unit is a first analysis unit and wherein said hearing device comprises a memory connected to said first analysis unit in which said first analysis unit causes a plurality of successive comparison results to be stored over time, and a second analysis unit, having access to said memory, said second analysis unit being configured to analyze the comparison results over time stored in said memory and to emit a warning signal when said comparison results over time indicate a deterioration of said hearing impairment.

5. The hearing device as claimed in claim 4 comprising an external unit, remote from said housing, configured to communicate with said second analysis unit, to which said second analysis unit transmits said warning signal.

6. The hearing device as claimed in claim 5 wherein said external unit comprises a display at which a text associated with said warning signal is displayed.

7. The hearing device as claimed in claim 1 wherein said level measuring unit is configured to generate an average value of said ambient sound level as said current, measured ambient sound level.

8. A method for operating a hearing device having a housing, an audio input unit and an audio output unit contained in said housing, and a signal processor connected in said housing between said audio input unit and said audio output unit, said signal processor being configured to operate according to a plurality of processing parameters, each of said processing parameters having a setting within a setting range, and a manually-operable operating element mounted to and manually accessible from an exterior of said housing, said method comprising the steps of:

manually operating said operating element, to adjust one of said parameters to a current setting, from among a plurality of settings in said setting range, to set a sound level at said audio output unit;

with a level measuring unit connected to said audio input unit, measuring an ambient sound level, detected by said audio input unit, in the vicinity of the housing;

in an analysis unit in said housing comparing the current setting, manually made via the operating element, with a current, measured ambient sound level measured by said level measuring unit, to obtain a comparison result, and generating a control signal, dependent on the comparison result, and supplying said control signal to said signal processor; and in said signal processor, automatically re-adjusting the setting range of said one of said parameters when said comparison result indicates said current setting is at a boundary of said setting range.

9. The method as claimed in claim 8 comprising setting an amplification gain of said signal processing unit as said one of said parameters.

10. The method as claimed in claim 8 wherein said housing has a size and configuration allowing said housing to be worn at an ear of a person having a hearing impairment, and wherein said analysis unit is a first analysis unit and wherein said hearing device comprises a memory connected to said first analysis unit, and a second analysis unit, and wherein said method comprises, from said first analysis unit, causing a plurality of successive comparison results to be stored over time in said memory, and, with said second analysis unit, accessing said memory to analyze the comparison results over time stored in said memory and emitting a warning signal when said comparison results over time indicate a deterioration of said hearing impairment.

11. The method as claimed in claim 9 comprising establishing communication to an external unit, remote from said housing, from said second analysis unit, and transmitting said warning signal from said second analysis unit to said external unit.

12. The method as claimed in claim 11 comprising, at said external unit, displaying a text associated with said warning signal.

13. The method as claimed in claim 8 comprising, in said level measuring unit, generating an average value of said ambient sound level as said current, measured ambient sound level.

* * * * *